US012421830B1

(12) United States Patent
Liu et al.

(10) Patent No.: US 12,421,830 B1
(45) Date of Patent: Sep. 23, 2025

(54) METHODS AND SYSTEMS TO STIMULATE ROCK SURROUNDING A WELLBORE USING ULTRASOUND AT A PREFERRED FREQUENCY

(71) Applicant: ARAMCO SERVICES COMPANY, Houston, TX (US)

(72) Inventors: Chao Liu, Brookshire, TX (US); Murtadha J. AlTammar, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/651,581

(22) Filed: Apr. 30, 2024

(51) Int. Cl.
*E21B 43/00* (2006.01)
*E21B 28/00* (2006.01)

(52) U.S. Cl.
CPC ..... *E21B 43/003* (2013.01); *E21B 28/00* (2013.01); *E21B 2200/20* (2020.05)

(58) Field of Classification Search
CPC ..... E21B 28/00; E21B 43/003; E21B 43/25
See application file for complete search history.

(56) References Cited

U.S. PATENT DOCUMENTS 3,990,512 A * 11/1976 Kuris ..... E21B 43/263 166/308.1
5,109,922 A * 5/1992 Joseph ..... E21B 43/003 166/65.1
5,265,461 A 11/1993 Steiger et al.
7,059,403 B2 6/2006 Arnoldo Barrientos et al.
7,063,144 B2 6/2006 Abramov et al.
7,770,638 B2 8/2010 Kabishcher et al.
8,387,743 B2 3/2013 Oraby
8,614,929 B2 12/2013 Rasolofosaon et al.
9,567,819 B2 2/2017 Cavender et al.
9,580,997 B2 2/2017 Levitov
10,513,909 B2 * 12/2019 Brodsky ..... E21B 47/10
(Continued)

FOREIGN PATENT DOCUMENTS

CN 104329064 A * 2/2015 ..... E21B 28/00
CN 107152265 A * 9/2017 ..... E21B 43/20
(Continued)

OTHER PUBLICATIONS

M.A. Borr, "Theory of Propagation of Elastic Waves in a Fluid-Saturated Porous Solid. II. High Frequency Range," The Journal of The Acoustical Society of America, vol. 28, No. 2, 1956 (14 pages).
(Continued)

*Primary Examiner* — Jennifer H Gay
(74) *Attorney, Agent, or Firm* — Osha Bergman Watanabe & Burton LLP

(57) ABSTRACT

Methods and systems are disclosed. The method may include obtaining, using a rock characterization system, a plurality of characteristics for a rock penetrated by a wellbore, and determining, using a model of poroelasticity and the plurality of characteristics, a preferred ultrasonic frequency at which to insonify the rock. The method may further include deploying an ultrasonic stimulation tool in the wellbore, where the ultrasonic stimulation tool comprises at least one ultrasonic transducer, and activating the ultrasonic stimulation tool at the preferred ultrasonic frequency.

18 Claims, 11 Drawing Sheets

(56) References Cited

U.S. PATENT DOCUMENTS

| | | | | |
|---|---|---|---|---|
| 10,612,348 | B2 | 4/2020 | Kamler et al. | |
| 10,669,796 | B2 * | 6/2020 | Saltykov | E21B 28/00 |
| 10,677,052 | B2 | 6/2020 | Storm, Jr. et al. | |
| 12,031,431 | B2 * | 7/2024 | Valero | E21B 49/088 |
| 12,105,242 | B2 * | 10/2024 | Bai | G06F 30/20 |
| 2001/0011590 | A1 * | 8/2001 | Thomas | E21B 43/003 166/248 |
| 2008/0066534 | A1 * | 3/2008 | Reid | E21B 49/081 73/152.09 |
| 2008/0306692 | A1 * | 12/2008 | Singer | G01V 1/50 702/11 |
| 2009/0120633 | A1 * | 5/2009 | Webb | E21B 33/1243 166/249 |
| 2018/0135385 | A1 * | 5/2018 | Brodsky | E21B 47/06 |
| 2018/0363441 | A1 * | 12/2018 | Tutuncu | E21B 43/267 |
| 2019/0271202 | A1 * | 9/2019 | Saltykov | E21B 43/25 |
| 2022/0050224 | A1 * | 2/2022 | Bai | G06F 30/20 |
| 2023/0383649 | A1 * | 11/2023 | Valero | G01V 1/116 |
| 2024/0192391 | A1 * | 6/2024 | Liu | G06F 17/16 |
| 2025/0052141 | A1 * | 2/2025 | Almani | E21B 47/022 |

FOREIGN PATENT DOCUMENTS

| | | | | |
|---|---|---|---|---|
| RU | 2765786 | C1 * | 2/2022 | |
| WO | WO-2009086279 | A2 * | 7/2009 | E21B 33/124 |
| WO | WO-2013148623 | A1 * | 10/2013 | G01V 1/50 |
| WO | 2018021949 | A1 | 2/2018 | |

OTHER PUBLICATIONS

M.A. Biot, "Theory of Propagation of Elastic Waves in a Fluid-Saturated Porous Solid. I. Low-Frequency Range," The Journal of the Acoustical Society of America, vol. 28, No. 2, 1956 (12 pages).

Sergio Calcedo, "Feasibility Study of Ultrasound for Oil Well Stimulation on the Basis of Wave-Properties Considerations," SPE-107083, 2007 SPE Latin American and Caribbean Petroleum Engineering Conference, Buenos Aires, Feb. 2009 (6 pages).

A. Venkitaraman, et al., "Ultrasonic Removal of Near Wellbore Damage Caused by Fines and Mud Solids," SPE 27388, Society of Petroleum Engieers, 1995 (5 pages).

M.S. Mullakaev, et al., "Development of ultrasonic equipment and technology for well stimulation and enhanced oil recovery," Elsevier B.V., 2014 (8 pages).

C. Perez-Arancibia, et al., "Modeling and simulation of an acoustic well stimulation method," Wave Motion, 2017 (18 pages).

* cited by examiner

METHODS AND SYSTEMS TO STIMULATE ROCK SURROUNDING A WELLBORE USING ULTRASOUND AT A PREFERRED FREQUENCY

BACKGROUND

Wellbores are routinely drilled to produce hydrocarbons, such as oil and gas, from subterranean hydrocarbon reservoirs. To reach the surface via the wellbore the hydrocarbons must flow from the hydrocarbon reservoirs through an annulus of rock surrounding the wellbore. Consequently, it is advantageous for the annulus to have a large permeability to facilitate the flow of hydrocarbons.

However, wellbores are routinely drilled with drilling mud, an oil or water-based liquid, designed to cool and lubricate the drill bit, carry the fragments of rock ("cuttings") generated by the drilling process to the surface, and maintain a fluid pressure in the wellbore sufficient to prevent the premature flow of hydrocarbons into the wellbore. To achieve the necessary fluid pressure and viscosity powdered solid material, such are typically added to the oil or water of the drilling mud. The resulting elevated fluid pressure, required to prevent premature inflow of pore fluids, may act to force a portion of the drilling mud, including the powdered solids into the pores of the surrounding rock annulus creating what is frequently termed an "invaded zone". In the invade zone the powdered solids, frequently termed "fines" due to their small or fine size, become lodged in the pores of the rock and particularly the narrow junctions between pores ("pore throats") reducing the permeability of the invaded zone.

A method for efficiently and reliably dislodging these fines and increasing the permeability of the invaded zone is a pressing need.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to a method. The method includes obtaining, using a rock characterization system, a plurality of characteristics for a rock penetrated by a wellbore, and determining, using a model of poroelasticity and the plurality of characteristics, a preferred ultrasonic frequency at which to insonify the rock. The method may further include deploying an ultrasonic stimulation tool in the wellbore, where the ultrasonic stimulation tool comprises at least one ultrasonic transducer, and activating the ultrasonic stimulation tool at the preferred ultrasonic frequency.

In general, in one aspect, embodiments relate to a method an ultrasonic stimulation tool. The tool includes a cylindrical housing having a first end and a second end, a first hydraulic packer mounted on the cylindrical housing proximal to the first end and a second hydraulic packer mounted on the cylindrical housing proximal to the second end, and a fluid channel penetrating the first hydraulic packer. The tool may also include a pumping system fluidly connected to the fluid channel, and an ultrasonic transducer mounted on the cylindrical housing and disposed between the hydraulic packer proximal to each end, configured to emit radiated ultrasonic waves at a preferred frequency upon command from a well logging system, where the preferred frequency is determined, using a model of poroelasticity, from characteristics of a rock.

In general, in one aspect, embodiments relate to an ultrasonic stimulation system, including a rock characterization system, a computer system, an ultrasonic stimulation tool, and a well logging system. The rock characterization system is configured to obtain a plurality of characteristics for a rock penetrated by a wellbore. The computer system is configured to determine, using a model of poroelasticity and the plurality of characteristics, a preferred ultrasonic frequency at which to insonify the rock. The ultrasonic stimulation tool includes at least one ultrasonic transducer and is configured to emit radiated ultrasonic waves at the preferred frequency upon receipt of a command from the well logging system that is configured to transmit a command to activate the ultrasonic stimulation tool.

Other aspects and advantages of the claimed subject matter will be apparent from the following description and the appended claims.

BRIEF DESCRIPTION OF DRAWINGS

Specific embodiments disclosed herein will now be described in detail with reference to the accompanying figures. Like elements in the various figures are denoted by like reference numerals for consistency. Like elements may not be labeled in all figures for the sake of simplicity.

FIGS. 4A-1 and 4A-2 shows well logs and rock types in accordance with one or more embodiments.

DETAILED DESCRIPTION

Figure 1:
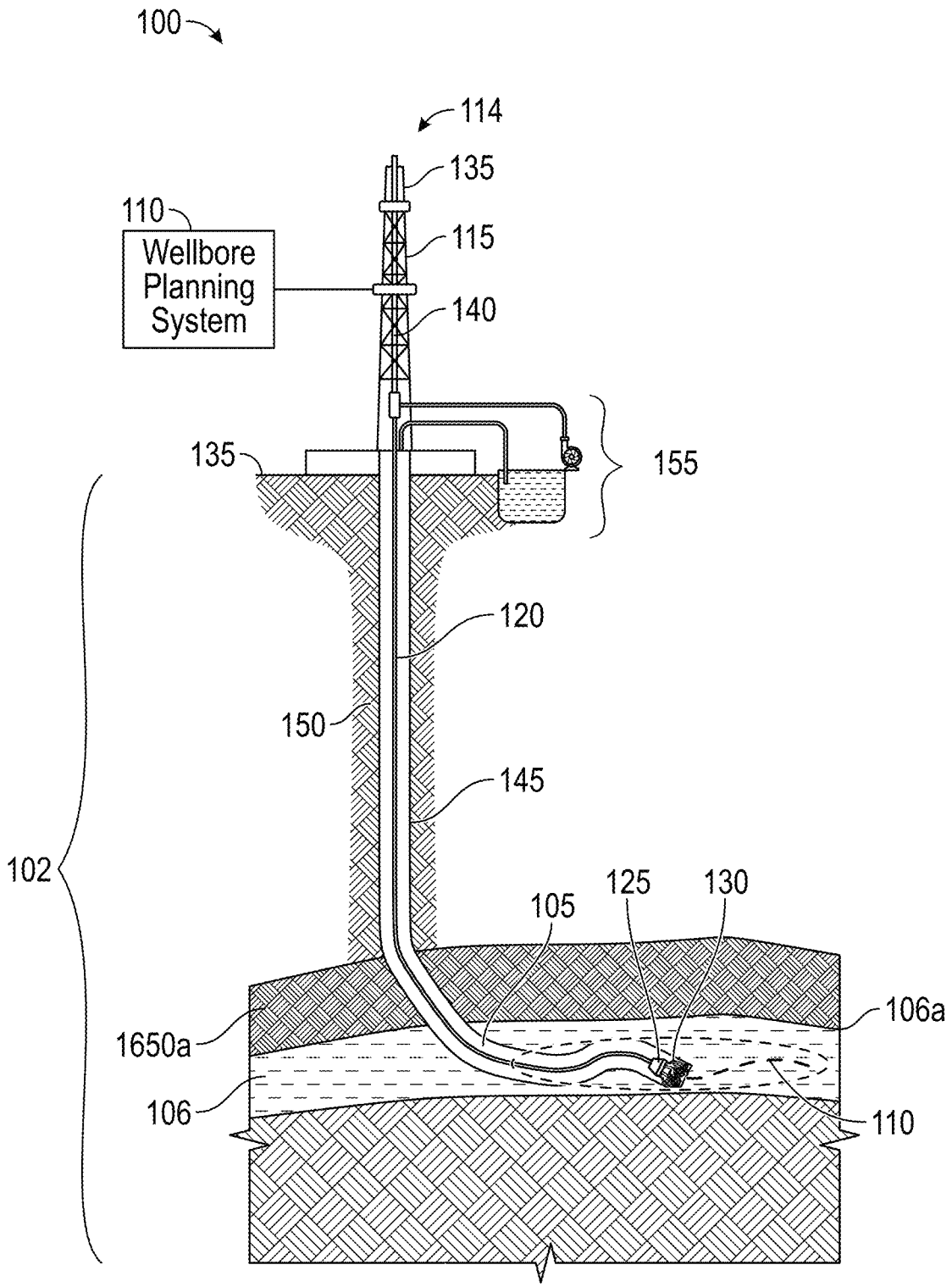
FIG. 1 depicts a drill rig site and drilling system in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-7, any component described with regard to a figure, in various embodiments disclosed herein, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

It is to be understood that the singular forms "a," "an," and "the" include plural referents unless the context clearly dictates otherwise. Thus, for example, reference to "an ultrasonic source" includes reference to one or more of such sources.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that one or more of the steps shown in the flowcharts may be omitted, repeated, and/or performed in a different order than the order shown. Accordingly, the scope disclosed herein should not be considered limited to the specific arrangement of steps shown in the flowcharts.

Although multiple dependent claims are not introduced, it would be apparent to one of ordinary skill that the subject matter of the dependent claims of one or more embodiments may be combined with other dependent claims.

Producing hydrocarbons from a hydrocarbon reservoir through a wellbore penetrating the reservoir requires reservoir fluids, such as oil and/or gas, to flow through an annulus surrounding the wellbore. The permeability of this annulus may have been reduced by the percolation of drilling mud carrying powdered solid material (known as "fines") into an annulus of the rock surrounding the wellbore during drilling. These fines may be lodged in the pores, and particularly the junction between pores (pore "throats") thus hindering the desired flow of hydrocarbons during production.

These fines may be cleared from the pores and pore throats by exciting the rock, and particularly the fluid within the pores of the rock, ultrasonically. This ultrasonic excitation may be supplemented by simultaneously, subsequently, or cyclically, reducing the fluid pressure in the wellbore to flush the ultrasonically-dislodged fines back into the wellbore and conveying them to the surface. Conventional methods for determining a desired frequency of ultrasonic excitation have either been based upon previous experience, experimentation, trial-and-error, rules of thumb, or maximizing the energy of ultrasonic excitation radiated into the formation surrounding the wellbore. None of these approaches reliably identify and use a preferred frequency at which the fluctuation of pore fluid pressure induced by the ultrasonic insonification occurs.

Disclosed are methods and systems for determining a preferred frequency, or range of frequencies, at which it is advantageous to ultrasonically excite the rock surrounding the formation to effectively dislodge the fines trapped within the pores and pore throats. As such, it represents an improvement over existing methods for selecting an excitation frequency.

FIG. 1 illustrates a drilling system (114) located at a drilling site (100) in accordance with one or more embodiments. A wellbore (105) may be drilled, using the drilling system (114), guided by the planned wellbore path (110) to penetrate the hydrocarbon reservoir (106). Although the drilling system (114) shown in FIG. 1 is used to drill the wellbore (105) on land, the drilling system (114) may also be a marine wellbore drilling system mounted on a jack-up rig, semi-submersible rig, or drill ship. The example of the drilling system (114) shown in FIG. 1 is illustrative and not meant to limit the scope of the present disclosure.

The drill system may be equipped with a hoisting system, such as a derrick (115), which can raise or lower the drillstring (120) and other tools required to drill the wellbore (105). The drillstring (120) may include one or more drill pipes connected to form conduit and a bottom hole assembly (125) ("BHA") disposed at the distal end of the drillstring (120). The BHA (125) may include a drill bit (130) to cut into rock (150), including cap rock (150*a*). The BHA (125) may further include measurement tools, such as a measurement-while-drilling ("MWD") tool and logging-while-drilling ("LWD") tool. MWD tools may include sensors and hardware to measure downhole drilling parameters, such as the azimuth and inclination of the drill bit (130), the weight-on-bit, and the torque. The LWD measurements may include sensors, such as resistivity, gamma ray, sonic and neutron density sensors, to characterize the rock (150) surrounding the wellbore (105). Both MWD and LWD measurements may be transmitted to the surface of the earth (135) using any suitable telemetry system known in the art, such as a mud-pulse telemetry or by wired-drill pipe telemetry.

To start drilling, or "spudding in," the wellbore (105), the hoisting system lowers the drillstring (120) suspended from the derrick (115) towards the planned surface location of the wellbore (105). An engine, such as a diesel engine, may be used to supply power to the top drive (135) to rotate the drillstring (120) via the drive shaft (140). The weight of the drillstring (120) combined with the rotational motion enables the drill bit (130) to bore the wellbore (105).

The near-surface of the subterranean region of interest 100 is typically made up of loose or soft sediment or rock (150), so large diameter casing (145) (e.g., "base pipe" or "conductor casing") is often put in place while drilling to stabilize and isolate the wellbore (105). At the top of the base pipe is the wellhead, which serves to provide pressure control through a series of spools, valves, or adapters (not shown). Once near-surface drilling has begun, water or drill fluid may be used to force the base pipe into place using a pumping system until the wellhead is situated just above the surface of the earth 135.

Drilling may continue without any casing (145) once deeper or more compact rock (150) is reached. While drilling, a drilling mud system (155) may pump drilling mud from a mud tank on the surface of the earth 135 through the center of the drillstring (120), the bottomhole assembly (125), and nozzles in the drill bit (130) then returns to the surface through the annulus created by the drillstrong (120) and the walls of the wellbore (105). Drilling mud serves to cool and lubricate drilling equipment and flush away rock chips generated during drilling. Typically, the composition, specifically the density, of drilling mud is chosen to maintain a greater fluid pressure within the wellbore (105) than the surrounding rock (150), thus preventing pore fluids flowing from the rock (150) into the wellbore (105) prematurely.

Drilling mud may be water based or oil based, mixed with powdered solid material, such as bentonite and barite for viscosity and weight, and various liquids such as emulsifiers and detergents to enhance lubrication. Near the bottom ("toe") of the wellbore (105), where the drill bit (130) is deepening the wellbore (105), the elevated fluid pressure, required to prevent premature inflow of pore fluids, acts to force a portion of the drilling mud, including the entrained solids into the pores of the surrounding rock (150). This has the desirable of establishing a low permeability coating on the wellbore wall ("mudcake") that inhibits further loss of drilling mud to the surrounding rock (150). However, particularly before the mudcake is well established the elevated fluid pressure may also force the drilling mud, together with the powdered solids further into an annulus surrounding the wellbore creating what is frequently termed an "invaded zone". In the invade zone the powdered solids, frequently termed "fines" due to their small or fine size, become lodged in the pores of the rock.

At planned depth intervals, drilling may be paused and the drillstring (120) withdrawn from the wellbore (105). Sections of casing (145) may be connected and inserted and cemented into the wellbore (105). Casing string may be cemented in place by pumping cement and mud, separated by a "cementing plug," from the surface of the earth 135 through the drill pipe. The cementing plug and drilling mud force the cement through the drill pipe and into the annular space between the casing (145) and the wall of the wellbore (105). Once the cement cures, drilling may recommence. The drilling process is often performed in several stages. Therefore, the drilling and casing cycle may be repeated more than once, depending on the depth of the wellbore (105) and the pressure on the walls of the wellbore (105) from surrounding rock (150).

Due to the high pressures experienced by deep wellbores (105), a blowout preventer (BOP) may be installed at the wellhead to protect the rig and environment from unplanned oil or gas releases. As the wellbore (105) becomes deeper, both successively smaller drill bits (130) and casing (145) may be used. Drilling deviated or horizontal wellbores (105) may require specialized drill bits (130) or drill assemblies.

The drilling system (114) may be disposed at and communicate with other systems in the wellbore environment. The drilling system (114) may control at least a portion of a drilling operation by providing controls to various components of the drilling operation. In one or more embodiments, the system may receive data from one or more sensors arranged to measure controllable parameters of the drilling operation. As a non-limiting example, sensors may be arranged to measure weight-on-bit, drill rotational speed (RPM), flow rate of the mud pumps (GPM), and rate of penetration of the drilling operation (ROP). Each sensor may be positioned or configured to measure a desired physical stimulus. Drilling may be considered complete when a drilling target with the hydrocarbon reservoir (106) is reached or the presence of hydrocarbons is established.

Figure 2A:
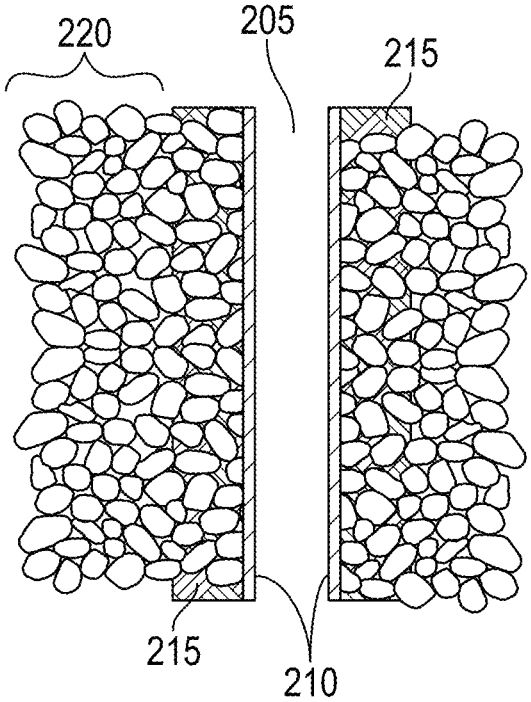
FIGS. 2A-2C depict a wellbore penetrating a porous material such as a rock, in accordance with one or more embodiments.
Figure 2B:
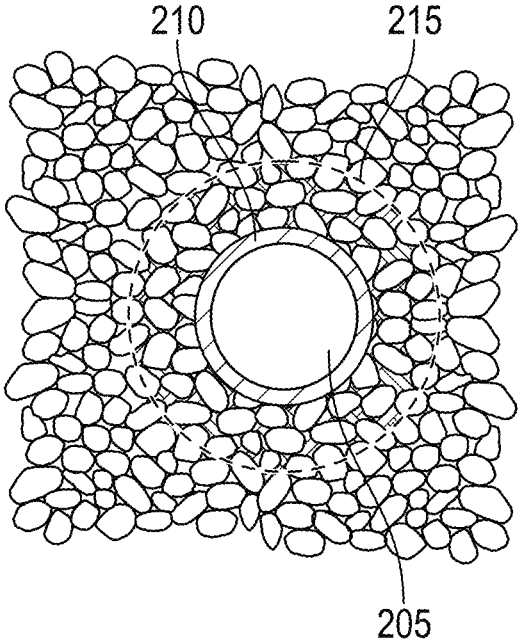
Figure 2C:
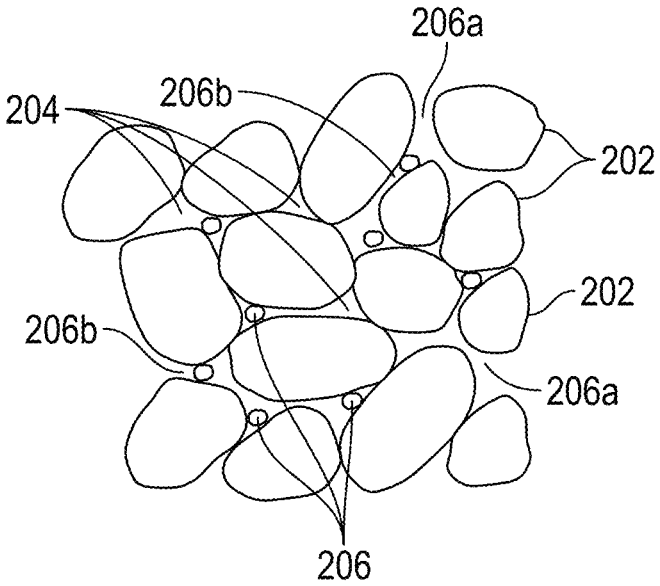

FIGS. 2A and 2B depict a wellbore penetrating a porous material such as a rock, in accordance with one or more embodiments. FIG. 2A shows a plane section of the wellbore (205) containing the wellbore axis lies. FIG. 2B shows a plane perpendicular to the wellbore axis lies. For a vertical well, the plane of FIG. 2B may be horizontal. The rock (250) may be composed of a plurality of grains (202), that are typically in contact with one another to form a "matrix", interspersed by a plurality of pores (204) that may also be connected to one another at pore throats. FIG. 3C depicts the grains (202) and pores (204) at a greater degree of magnification.

The rock (250) is shown penetrated by a wellbore (205). The walls of the wellbore (205) may be coated with mudcake (210) while the annulus surrounding the mudcake (210) may form an invaded zone (215) within which the pores (204) may be filled with fines. The presence of fines in the invade zone (215) may decrease both the porosity and the permeability of the rock (150) within the invaded zone (215) relative to the rock outside the invade zone (215) and relative to the permeability of the rock (150) within the invaded zone (215) prior to drilling.

Beyond the invaded zone may lie a portion of the rock whose porosity and permeability may be unaffected by the drilling of the wellbore. In this "virgin zone" (220) the pores (204) may be filled with in situ pore fluid that, in the case that the rock forms part of a hydrocarbon reservoir, may be hydrocarbons, such as oil and/or gas. In order to produce the hydrocarbon pore fluids from the virgin zone (220) the hydrocarbon pore fluid must be drawn from the virgin zone (220) through the invade zone (215) and mudcake (210) and into the wellbore (205). The hydrocarbon pore fluids may be drawn into the wellbore (205) by establishing a lower fluid pressure in the wellbore (205) than in the virgin zone (220). This may be achieved simply by allowing the wellbore fluid to flow unchoked into surface pipelines or may require one or more surface or downhole pumps to pump the fluid in the wellbore (205) to the surface. However, reduced permeability of the invaded zone may impede the flow of pore fluid from the virgin zone (220) into the wellbore (205) and thus reduces the rate of production.

The mudcake (210) may be insecurely attached to the wall of the wellbore (105) primarily held in place by the excess of wellbore fluid pressure over pore fluid pressure. However, while the mudcake (210) may be removed relatively easily either by the initial flow of pore fluid into the wellbore (105) after the wellbore fluid pressure is reduced or by mechanical means to scrape off the mudcake (210), the fines trapped inside the pores and pore throats of the invade zone (215) may be much more difficult to dislodge.

Returning to FIG. 3C, FIG. 3C depicts a high resolution section through a sample of rock within the invaded zone (215). As such, in addition to the matrix of the rock, formed by grains (202) in contact with one another, and pores (204), FIG. 3C depicts a plurality of fines (206) lodged within the pores (204). The presence of any fines (206) has the effect of reducing the porosity of the rock within the invaded zone (215) but the presence of fines trapped in the pore throats forming the junction between adjacent pores, such as pore throats (206*a*, 206*b*) particularly degrade the permeability of the invade zone (215). Open pore throats, such as pore throats (206*a*) allow the passage of hydrocarbon fluid and hence contribute to higher permeability of the rock than do blocked pore throats (206*b*).

Characteristics of the rock (150) penetrated by a wellbore (105) may be obtained by one or more of several methods known in the art. For example, in some embodiments, measurements of the characteristics may be made in situ using tools lowered down the wellbore. A sequence of measurements made at incremental depths along a wellbore (105) is typically termed a "well log". Alternatively, or supplementarily, core samples may be taken from the rock (150) during or after drilling the wellbore (105) using a coring system and subjected to analysis in a laboratory. Measurements may include observations of elastic parameters, such as sonic compressional and shear velocities, and density, gamma ray, and porosity.

For example, sonic tools may take the form of an elongated cylinder on which are mounted one or more sonic sources, including a monopole source that radiates substantially equally in all azimuthal directions and one or more dipole sources oriented orthogonally to the sonic tool axis. In addition, a sonic tool may also include a plurality of sonic receivers disposed at intervals along the tool axis and at intervals around the tool azimuth. For example, the sonic receivers may be distributed at intervals of 6 inches along the axis or the sonic tool and at intervals of 45 or 90 degrees around the azimuth of the sonic tool. Sonic velocities may be determined based on the travel time taken for sonic signals to propagate from the source to one or more of the receivers or based upon the velocity at which the sonic signal propagates across the sonic receiver array, or both.

In some embodiments, density logging tools may involve the use of gamma rays and their interactions with the rock surrounding the wellbore. A gamma-ray source, such as cesium-137 or cobalt-60 radioactive elements, may emit gamma rays and a portion of these gamma rays may be detected by a gamma-ray detector mounted on the density logging tool. The detector may register the number of gamma rays that reach it and measures their energy.

The emitted gamma rays interact with the electrons in the rock and their flux intensity decreases as they pass through the rock, prior to their detection by the density logging tool. This attenuation is influenced by the density of the formation. In addition to attenuation, some gamma rays may undergo Compton scattering. This occurs when gamma rays interact with electrons and change direction while losing a portion of their energy. The amount of Compton scattering is also related to the density of the rock surrounding the density logging tool.

By analyzing the counts and energy distribution, the density logging tool can differentiate between different types of gamma-ray interactions and calculate the apparent density of the formation. Density logging tools are calibrated to account for the specific characteristics of the gamma-ray source and the detector. Calibration involves measuring the tool's response in materials of known density and composition to create a calibration curve. Corrections may be applied for tool geometry, wellbore conditions, and the effects of mudcake or other factors that may interfere with accurate measurements.

Gamma-ray logging tools are widely used in the oil and gas industry to measure the natural gamma radiation emitted by subsurface rocks and help in identifying lithology (rock type), stratigraphy, and the presence of certain minerals. Various elements within subsurface rocks emit gamma radiation naturally. A gamma ray logging tool includes a gamma-ray detector that may count the number and intensity of gamma rays as they traverse the wellbore. The rate of gamma-ray counts is directly related to the intensity of the natural gamma radiation in the rock surrounding the wellbore. Some gamma-ray logging tools are capable of measuring the energy spectrum of gamma rays detected. This spectral measurement can provide additional information about the specific isotopes responsible for the gamma radiation and help differentiate between different lithologies. Calibration of the gamma ray detector is important to convert the recorded gamma-ray counts into meaningful measurements. Calibration involves measuring the tool's response in materials of known gamma-ray emissions to create a calibration curve.

Different rock types and mineral compositions emit varying levels and types of gamma radiation. Thus, gamma-ray logs may be used to identify lithology changes and stratigraphic boundaries within the wellbore.

Porosity logging tools may employ a combination of neutron and density measurements to estimate porosity. Neutron and density tools are often run together in a logging suite to provide complementary information.

A neutron logging tool may include a neutron source, such as a chemical neutron generator or an accelerator-driven source, that emits high-energy neutrons into the formation. Neutrons may interact with the atomic nuclei in the formation. The two primary types of interactions are inelastic scattering where the neutrons lose energy, for example where they interact with hydrogen atoms, which are abundant in hydrocarbons and water, and elastic scattering where neutrons undergo scattering interactions with other nuclei but do not lose energy. A neutron detector disposed in the logging tool may measure the neutrons that return to the tool after scattering interactions in the formation. The detector may register the number of returning neutrons, and their energy provides information about the formation's hydrogen content. In addition to neutron measurements, density measurements may be made using gamma-ray attenuation.

Porosity may be calculated using a combination of the neutron and density measurements. The neutron measurement primarily provides information about hydrogen content, which is used to estimate the effective porosity. The density measurement helps correct for the presence of non-hydrogen elements in the formation, such as minerals.

Porosity logging tools are calibrated to account for the specific characteristics of the neutron source, detector response, and density measurement. Calibration involves measuring the tool's response in materials of known porosity to create calibration curves. Corrections may be applied to account for factors such as wellbore size, drilling mud properties, and tool response to ensure accurate porosity estimation.

Each of these measurements may require a separate downhole tool, however, typically these separate downhole tools may be connected into a single "tool string" and deployed together in the wellbore (150).

Figure 3A:
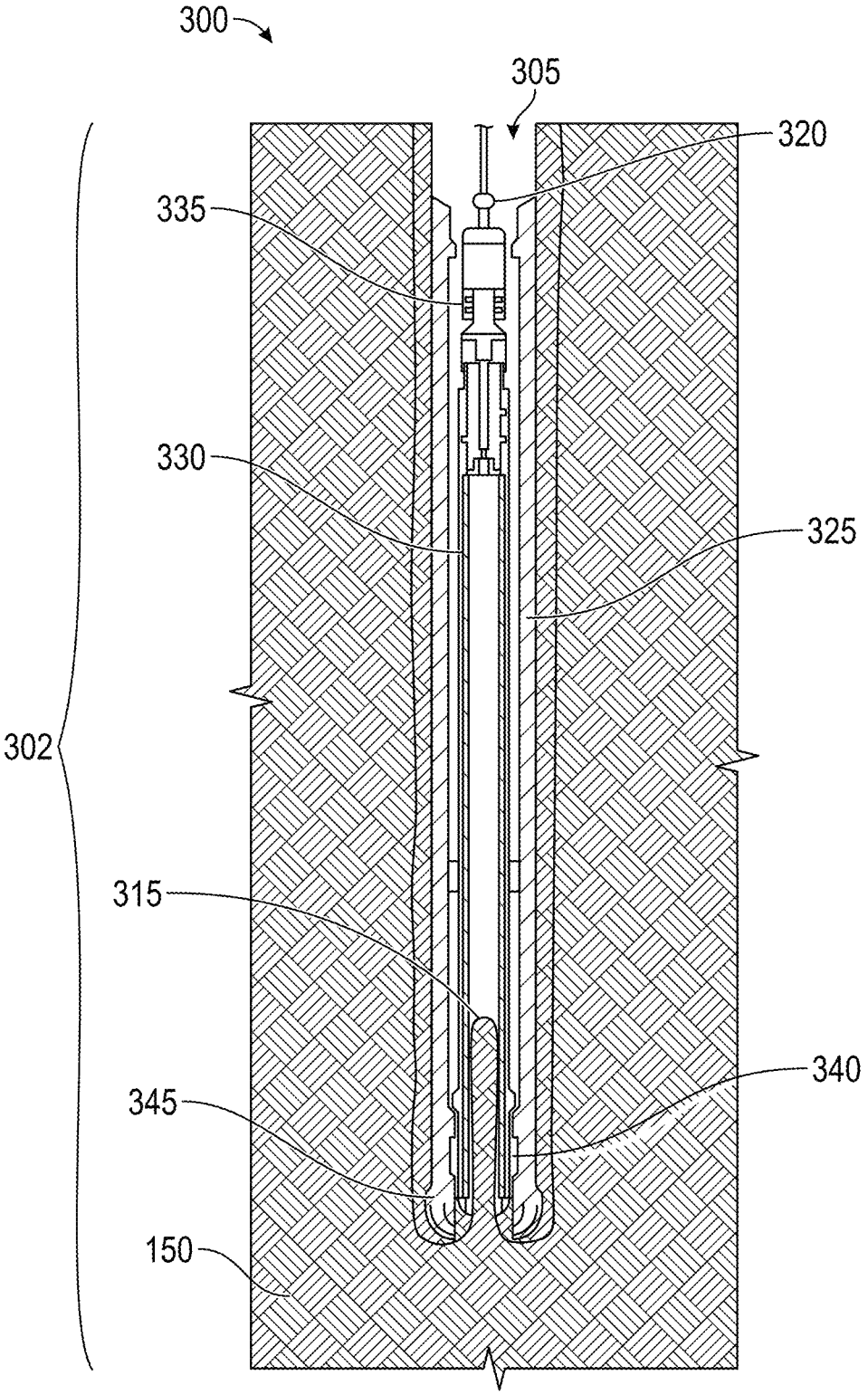
FIGS. 3A-3B depict wellbore coring systems in accordance with one or more embodiments.

In other embodiments, rock characteristics may be obtained from rock samples. Rock samples may be obtained from a subterranean region of interest using a rock coring system. FIG. 3A illustrates a rock coring system (300) in accordance with one or more embodiments. The rock coring system (300) is configured to simultaneously drill the wellbore (305) within a subterranean region of interest (302) and retrieve one or more ex situ rock cores (315) (hereinafter simply "rock cores") along an interval of the wellbore (305). As such, the rock coring system (300) may be part of a drilling system (114). The rock coring system (300) may collect rock cores (315) continuously or at intervals while drilling the wellbore (305). To do so, the rock coring system (300) may include a coring bit (345) attached to a core barrel (325). Within the core barrel (325), an inner barrel (330) is disposed between a swivel (335) attached to an upper portion of the core barrel (325) and a core catcher (340) is disposed close to the coring bit (345). The coring bit (345) consists of an annular cutting or grinding surface configured to flake, gouge, grind, or wear away the in situ rock (345) within the subterranean region of interest (302) at the base or "toe" of the wellbore (305). A central axial orifice is configured to allow a cylindrical rock core (315) to pass through. The annular cutting surface of the coring bit (345 typically includes embedded polycrystalline compact diamond (PDC) cutting elements.

The inner barrel (330) within the core barrel (325) may be disposed above or behind the coring bit (345). Further, the inner barrel (330) may be separated from the coring bit (345) by the core catcher (340). As the coring bit (320) grinds away the in situ rock (150) within the subterranean region of interest (310), the cylindrical rock core (315) passes through the central orifice of the coring bit (345) and through the core catcher (340) into the inner barrel (330) as the coring bit (345) advances deeper into the subterranean region of interest (302). The inner barrel (330) may be attached by the swivel (335) to the remainder of the core barrel (325) to permit the inner barrel (330) to remain stationary as the core barrel (325) rotates together with the coring bit (345). When the inner barrel (330) is filled with the rock core (315), the core barrel (325) containing the rock core (315) may be raised and retrieved at the surface of the earth (135). The core catcher (340) serves to grip the bottom of the rock core (315) and, as lifting tension is applied to the drillstring (350) and the core barrel (325), the rock core (315) breaks away from the undrilled in situ rock (150) within subterranean region of interest (310) below it. The core catcher (340) may retain the rock core (315) so that it does not fall out the bottom of the core barrel (325) through the annular orifice of the coring bit (320) as the core barrel (325) is raised to the surface of the earth (355).

Figure 3B:
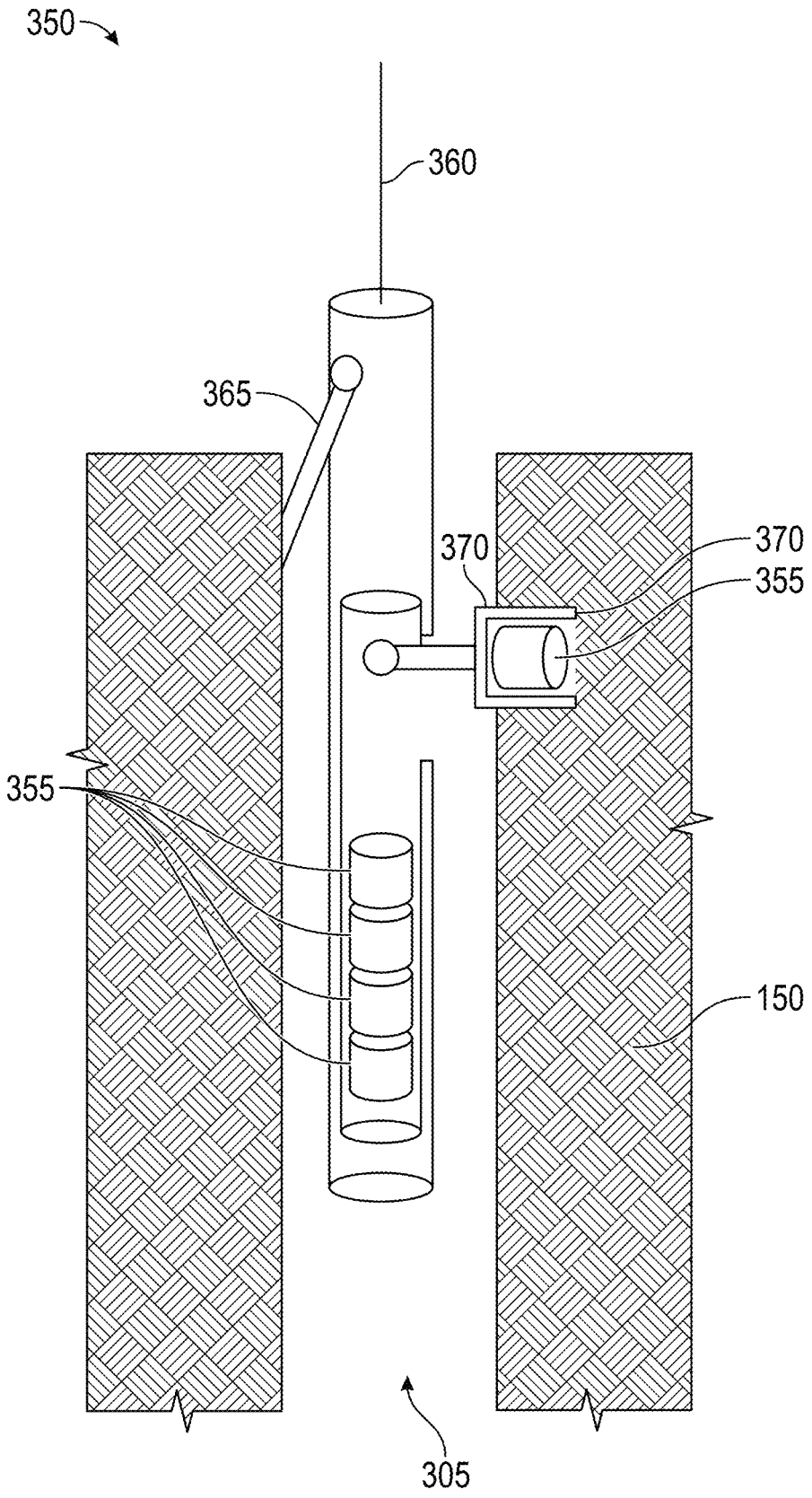

In addition to collecting rock cores (315) while drilling the wellbore (305), smaller "sidewall rock cores" (355) may be obtained after drilling a portion or all of the well (305). In some embodiments, as depicted in FIG. 3B, a sidewall rock coring system (350) may be lowered by wireline (360) into the well (305). When deployed, the sidewall rock coring system (350) presses or clamps itself, for example using a clamping arm (365) against the wall of the well (305) and a sidewall rock core (355) may be obtained either by drilling into the wall of the wellbore (305) with a hollow drill bit (370) or by firing a hollow bullet (not shown) into the wall of the wellbore (305) using an explosive charge. More than 50 such sidewall rock cores may be obtained during a single deployment of a sidewall rock coring system into the well (305). Hereinafter, the term "rock coring system" is used to describe the rock coring system 300, such as the one illustrated in FIG. 3A or the sidewall rock coring system (350) such as the one illustrated in FIG. 3B. Further, the term "rock cores" is used to describe the rock cores (315) obtained using either the rock coring system (300) as illustrated in FIG. 3A or the sidewall rock coring system as illustrated in FIG. 3B.

In general, the rock cores may be collected along any interval of the well (305). In particular, in the context of this disclosure, rock cores may be collected along the portion of the wellbore (305) that intersects a hydrocarbon reservoir within the subterranean region of interest (302). As such, rock cores may contain hydrocarbons.

Under ideal circumstances, each rock core (315) is recovered as a single, continuous, intact cylinder of rock. However, frequently, each rock core (315) takes the form of several shorter cylindrical segments separated by breaks. The breaks may be a consequence of stresses experienced by each rock core (315) during coring or may be caused by pre-existing vugs, channels, and/or fractures within the subterranean region of interest (302). In comparison, sidewall rock cores (355) are collected at discreet intervals along the wellbore. In general, each rock core (315) may be up to 15 centimeters in diameter and up to approximately ten meters long, whereas sidewall rock cores (355) may be 2 or 3 inches in diameter and 3 or 4 inches long.

To prepare a rock core 215 for laboratory analysis, each rock core (315) may be cut into multiple rock samples (e.g., core plugs). Each core plug may be in the shape of a cylinder (e.g., disc) or cuboid where each dimension is on the order an inch or two, though other shapes and dimensions may be used. Further, each rock sample may be cut along a particular axis of the well (305), such as parallel or perpendicular to the well (305).

In accordance with one or more embodiments, the model of poroelastodynamics may be a Biot model of linear poroelastodynamics, such as the theory described in "*Theory of Propagation of Elastic Waves in a Fluid-Saturated Porous Solid. I. Low-Frequency Range*" M. A. Biot, 1956. Journal of the Acoustical Society of America, Vol. 28, No. 2, pp. 168-178 and "*Theory of Propagation of Elastic Waves in a Fluid-Saturated Porous Solid. II. High-Frequency Range*" M. A. Biot, 1956. Journal of the Acoustical Society of America, Vol. 28, No. 2, pp. 179-191. The governing equations of Biot's theory may be written as:

$$G\nabla^2 u+(\lambda+\alpha^2 M+G)\nabla(\nabla\cdot u)+\alpha M\nabla(\nabla\cdot w)+\omega^2\rho u+\omega^2\rho_f w=0 \quad \text{Eqn (1)}$$

$$\alpha M\nabla(\nabla\cdot u)+M\nabla(\nabla\cdot w)+\omega^2\rho_f u+\omega^2\left(\frac{\rho_f}{\phi}+\frac{\rho_a}{\phi^2}+\frac{i}{\omega\kappa}\right)w=0 \quad \text{Eqn (2)}$$

where u and w are the solid displacement and the specific relative fluid to solid displacement, respectively, $\lambda$ and G are the Lamé parameters, $\alpha$ is the Biot's coefficient, M is Biot's modulus, $\rho_f$ is pore fluid density, $\phi$ is porosity, $\rho_a$ is the added mass density, $\omega$ is the frequency, $\kappa$ is the mobility, and $i=\sqrt{(-1)}$. "Added mass density" refers to the additional inertial effect of the pore fluid. When the rock matrix is accelerates or decelerates, by a propagating ultrasonic wave, a portion of pore fluid is forced to move with it. As a result, the inertia of the pore fluid generates a force on the rock matrix. According to Newton's second law, this generated force can be considered as an added mass density In some embodiments, Biot's theory may be expressed using other parameterizations, particularly other elastic coefficients instead of the Lamé parameters. For example, Biot's theory may be expressed using Young's modulus, bulk modulus and Poisson's ratio as an alternative parameterization. In other embodiments, different poroelastic models may be used, such as the linear model of poroelasticity or de Boer's Theory of Porous Media, "Theory of Porous Media" R. de Boer, 2000, https://doi.org/10.1007/978-3-642-59637-7.

Biot's coefficient may be defined by $$\alpha = 1-\frac{E}{3K_s(1-2\nu)},$$

where E and v are the Young's modulus and Poisson's ratio of the overall rock, and $K_s$ is the bulk modulus of the material of the grains forming the rock. E, and v, and $K_s$ may be determined through conventional laboratory measurements on core samples of the rock. In situations, where core samples are only available in from a spatially sparse set of locations, core measured Biot's coefficients may be correlated to one or a plurality of well log measurements of for example density and sonic velocity. The resulting correlation may be used to estimate Biot's coefficient in location in which core samples are not available.

In some embodiments, E and v may be determined from compressional velocity, $V_p$, and shear velocity, $V_s$, determined from sonic well logs and density, ρ, using:

$$E = \frac{\rho V_s^2(3V_p^2 - 4V_s^2)}{V_p^2 - V_s^2}$$

and $$v = \frac{V_p^2 - 2V_s^2}{2(V_p^2 - V_s^2)}.$$

$K_s$ may be estimated from well logs, using:

$$K_s = \frac{K - K_f\phi}{1 - \phi}$$

where $$K = \frac{E}{3(1 - 2v)},$$

$K_f$ is the pore fluid bulk modulus, and ϕ is the porosity determined from the porosity logs. In some cases, $K_f$ may be chosen to be equal to the bulk modulus of the drilling fluid used to drill the wellbore, since the drilling fluid typically percolates into, or "invades" the pore spaces of the rock surrounding the wellbore during wellbore drilling.

Proceeding with Biot's model, the pore pressure, p, and stresses may be obtained from u and w through the following equations:

$$p = -\alpha M\nabla\cdot u - M\nabla\cdot w \quad \text{Eqn (3)}$$

$$\sigma_{rr} = (\lambda + 2G)\frac{\partial u_r}{\partial r} + \lambda\frac{u_r}{r} + \lambda\frac{\partial u_Z}{\partial z} - \alpha p \quad \text{Eqn (4)}$$

$$\sigma_{\theta\theta} = \lambda\frac{\partial u_r}{\partial r} + (\lambda + 2G)\frac{u_r}{r} + \lambda\frac{\partial u_z}{\partial z} - \alpha p \quad \text{Eqn (5)}$$

$$\sigma_{zz} = \lambda\frac{\partial u_r}{\partial r} + \lambda\frac{u_r}{r} + (\lambda + 2G)\frac{\partial u_z}{\partial z} - \alpha p \quad \text{Eqn (6)}$$

$$\sigma_{rz} = G\left(\frac{\partial u_r}{\partial z} + \frac{\partial u_z}{\partial r}\right) \quad \text{Eqn (7)}$$

where $\sigma_{rr}$, $\sigma_{\theta\theta}$, and $\sigma_{zz}$ are the radial, tangential, and axial stresses, respectively.

The solutions for matrix displacement, pore pressure, and stress around a fluid-filled wellbore may be written as may be derived as follows:

$$u_r = -\Sigma_{n=1}^{\infty} n_{1m}\eta_{mn}J_1(r\eta_{mn}) - n_{1m}\sqrt{-\lambda_m}J_1(r\sqrt{-\lambda_m}) \quad \text{Eqn (8)}$$

$$p = -\sum_{n=1}^{\infty} a_{1k}n_{km}\left(\eta_{mn}^2 + \frac{n^2\pi^2}{h^2}\right)J_0(r\eta_{mn}) + a_{1k}n_{km}\lambda_m J_0\left(r\sqrt{-\lambda_m}\right) \quad \text{Eqn (9)}$$

$$\sigma_{rr} = [n_{1m}(\lambda + 2G) - \alpha a_{1k}n_{km}]\lambda_m J_0\left(r\sqrt{-\lambda_m}\right) + 2Gn_{1m}\frac{\sqrt{-\lambda_m}\,J_1\left(r\sqrt{-\lambda_m}\right)}{r} \quad \text{Eqn (10)}$$

where $n_{km}$, $\eta_{mn}$, and $\lambda_m$ are solution parameters dependent on rock properties and the ultrasonic frequency, and $J_0$, and $J_1$ are Bessel functions of the first kind, with order 0 and 1, respectively. The distance from the axis of the wellbore is denoted "r", and the subscripts "k" may take the integer values 1 or 2. $\alpha_{11} = -\alpha M$ and $\alpha_{12} = -M$.

The explicit expressions for the ultrasonic wavefield around the wellbore, equations (8), (9), and (10) may be used to calculate one or more preferred frequency at which fines may be preferentially dislodged within an annulus surrounding the wellbore.

For example, in some embodiments a preferred frequency may be determined that maximizes the peak pore pressure value at a specified distance beyond the wellbore. Specifically, a preferred frequency that maximize the peak pore pressure value at a distance equal to 10% of the wellbore radius beyond the wellbore may be determined.

In other embodiments, the preferred frequency may be determined that maximizes a spatial integral of the peak pore fluid pressure over an annulus beyond the wellbore wall may be determined. For example, the annulus over which the spatial integral is performed may extend from the wellbore wall to a distance equal to 25% of the radius of the wellbore beyond the wellbore wall.

In still other embodiments, the peak value of the radial derivative of the pore fluid pressure may be the parameter used to determine the preferred frequency. For example, the radial derivative at a specified distance beyond the wellbore wall, or a spatial average of the radial derivative over an annulus may be used.

In still further embodiments, one or more component of the displacement, velocity, or acceleration of the solid matrix of the rock, or of the displacement, velocity, or acceleration relative motion of the pore fluid and the matrix of the rock may be used to determine the preferred frequency.

Figures 1, 4A:
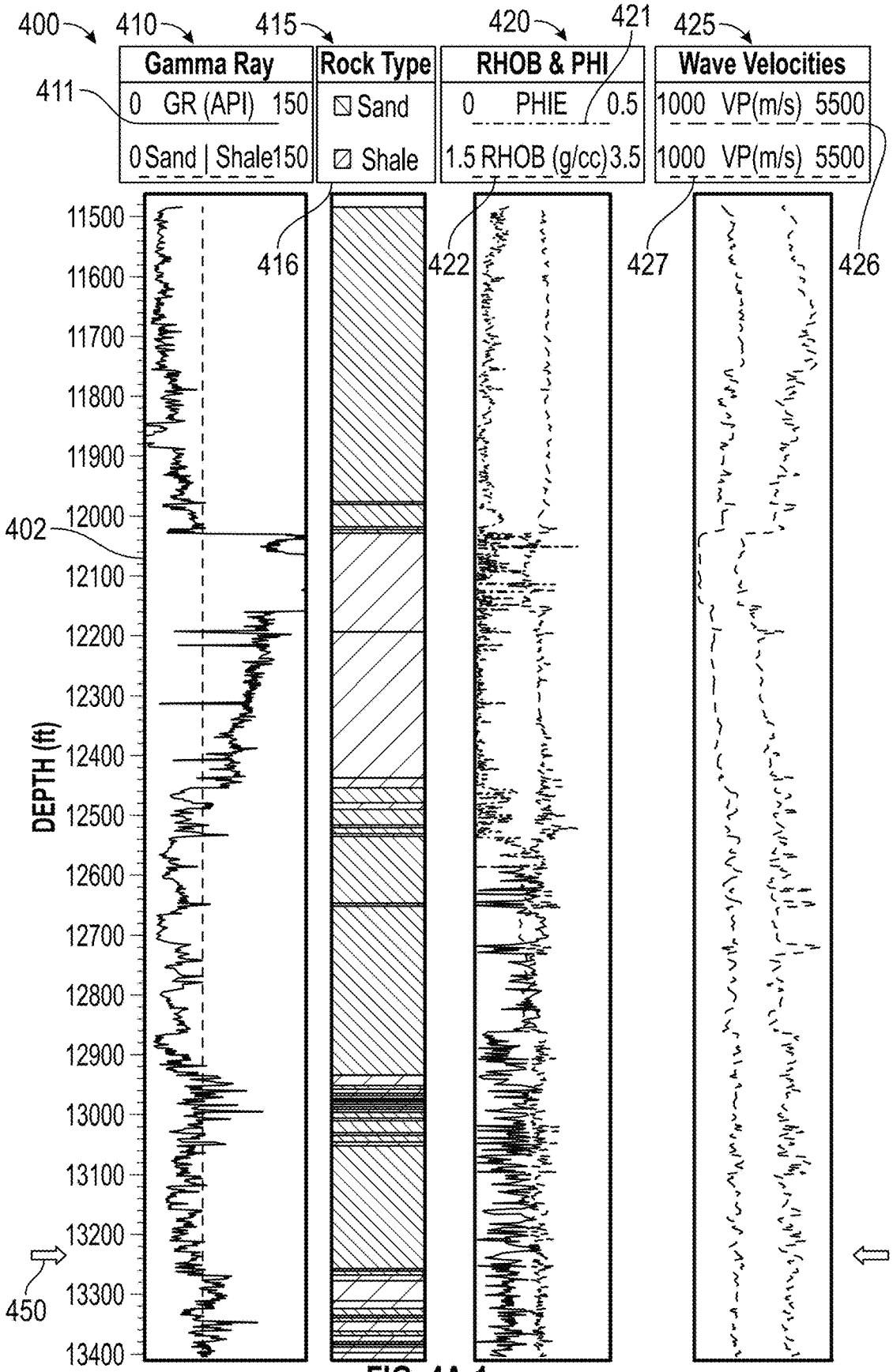
Figures 2, 4A:
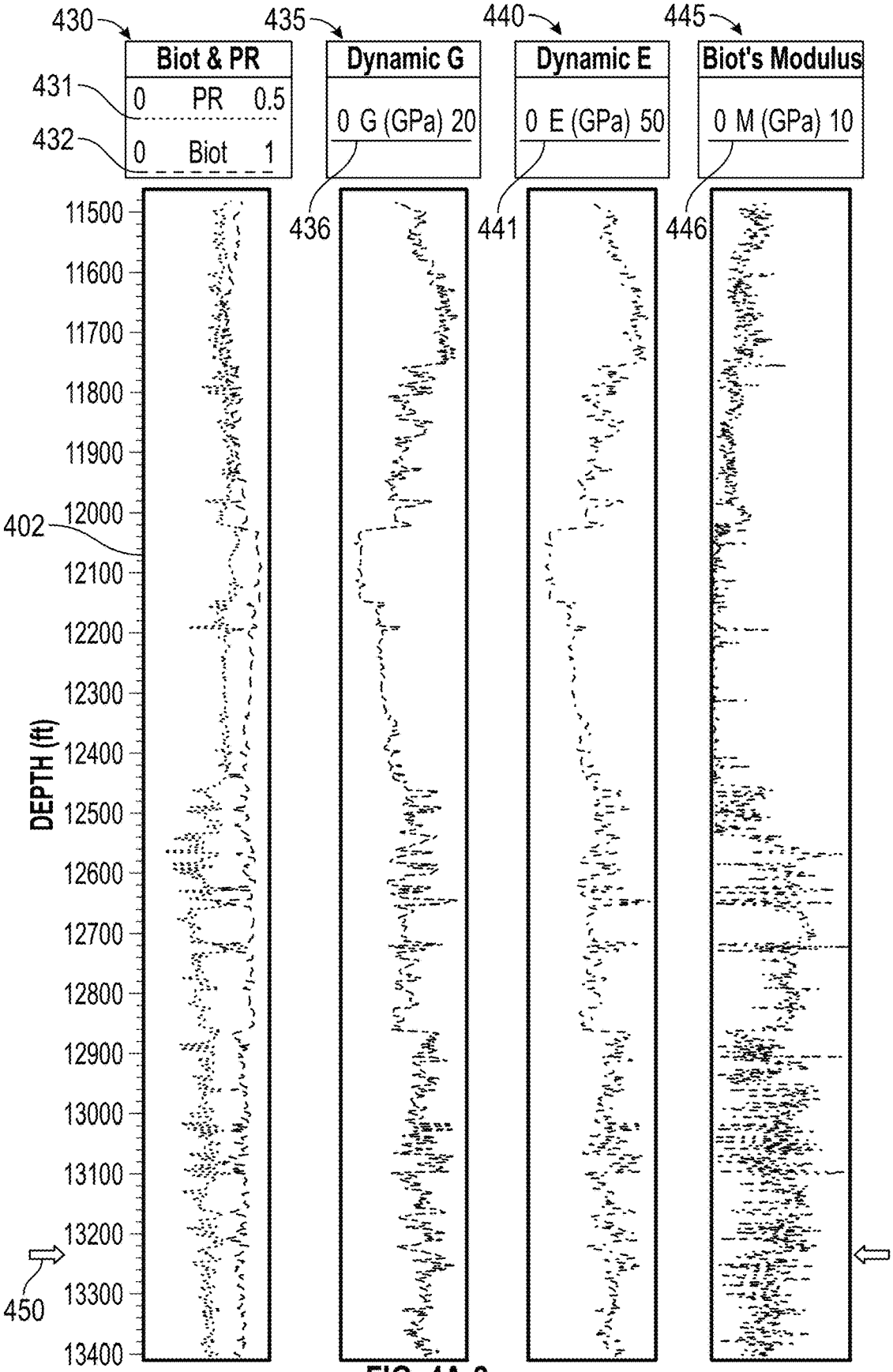

To illustrate the method a non-limiting example is provided in FIGS. 4A-1, 4A-2 and 4B. FIGS. 4A-1 and 4A-2 display a plurality of well log measurements (400) recorded in a wellbore, measured from cores taken from the wellbore, or derived therefrom. The well logs are display against depth on a vertical axis (402) with a plurality of different geophysical, petrophysical, or geological quantities displayed in panels or "tracks". For example, in track (410) the gamma ray value is displayed, with the value indicated on the horizontal axis (411). In track (415) the rock type is displayed with the category indicated by the legend (416). In track (420) the porosity and density are displayed with the values indicated by horizontal axes (421) and (422), respectively. In track (425) the sonic compressional and shear velocities are displayed with the values indicated by horizontal axes (426) and (427), respectively. In track (430)

Biot's coefficient and Poisson's ratio are displayed with the values indicated by horizontal axes (431) and (432), respectively.

Figure 4B:
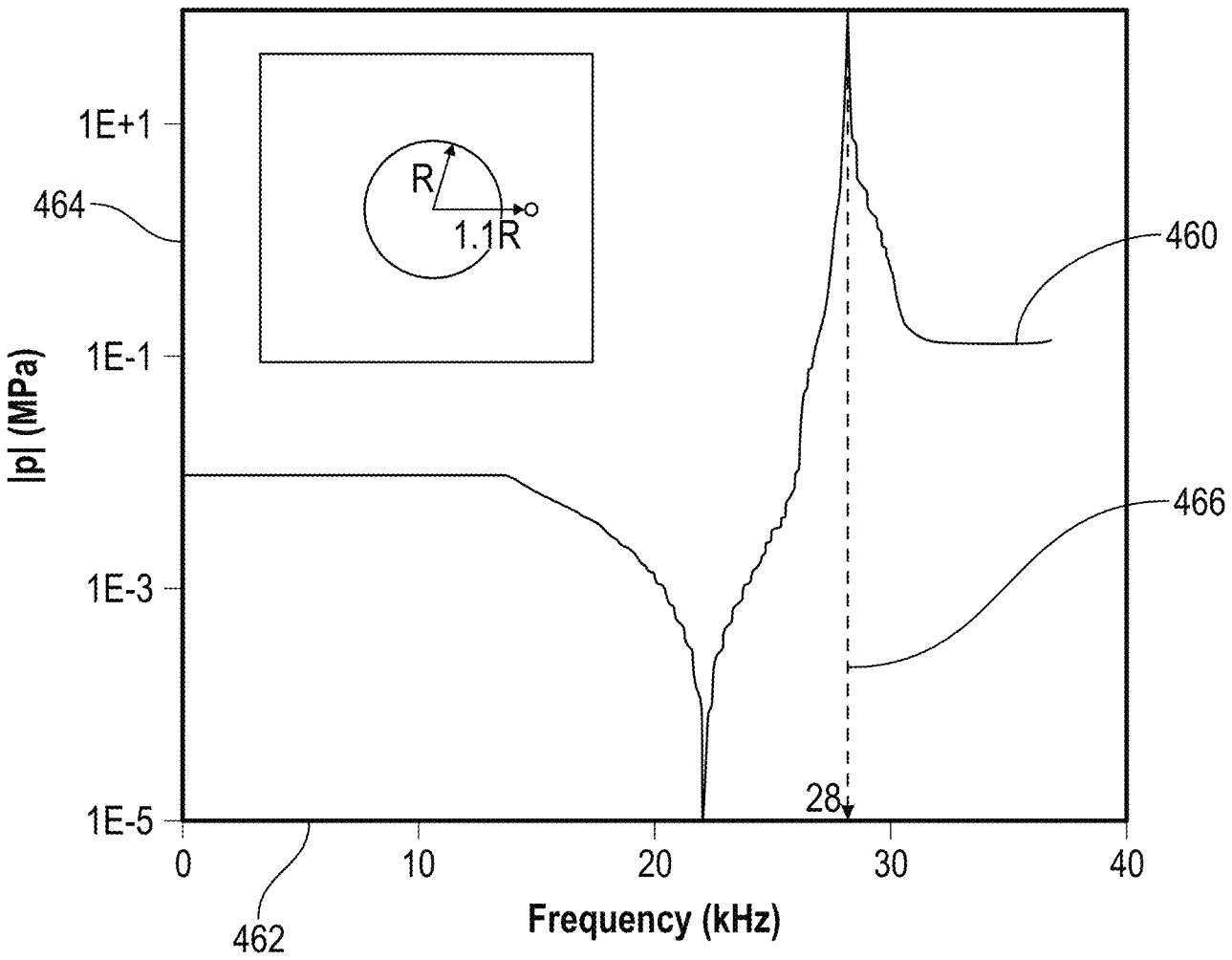
FIG. 4B shows the predicted pore fluid pressure as a function of frequency in accordance with one or more embodiments.

In track (435) Lamé's shear parameter G is displayed with the value indicated by horizontal axes (436). In track (440) Young's modulus is displayed with the value indicated by horizontal axes (441). Finally, in track (445) Biot's modulus is displayed with the value indicated by horizontal axes (446). An illustrative depth (450) is indicated FIG. 4B shows the predicted pore fluid pressure as a function of frequency (460) at the illustrative depth (450) at a distance beyond the wall of the wellbore equal to 10% of the wellbore radius. Excitation frequency is indicated on the horizontal axis (462) on a linear scale, while peak pore fluid pressure excited by the ultrasonic stimulation source is indicated on the vertical axis (464) using a logarithmic scale. While the peak pore fluid pressure excited by the ultrasonic stimulation source below approximately 13 kHz is essentially constant, above 13 kHz the peak pore fluid pressure varies by six orders of magnitude (a factor of 1 million) from a minimum at approximately 22 kHz to a maximum at 28 kHz indicated by the vertical line (466). In some embodiments, the preferred frequency may be this maximum frequency, while in other embodiments the preferred frequency may be a range or frequencies surrounding and including this maximum frequency.

Figure 5A:
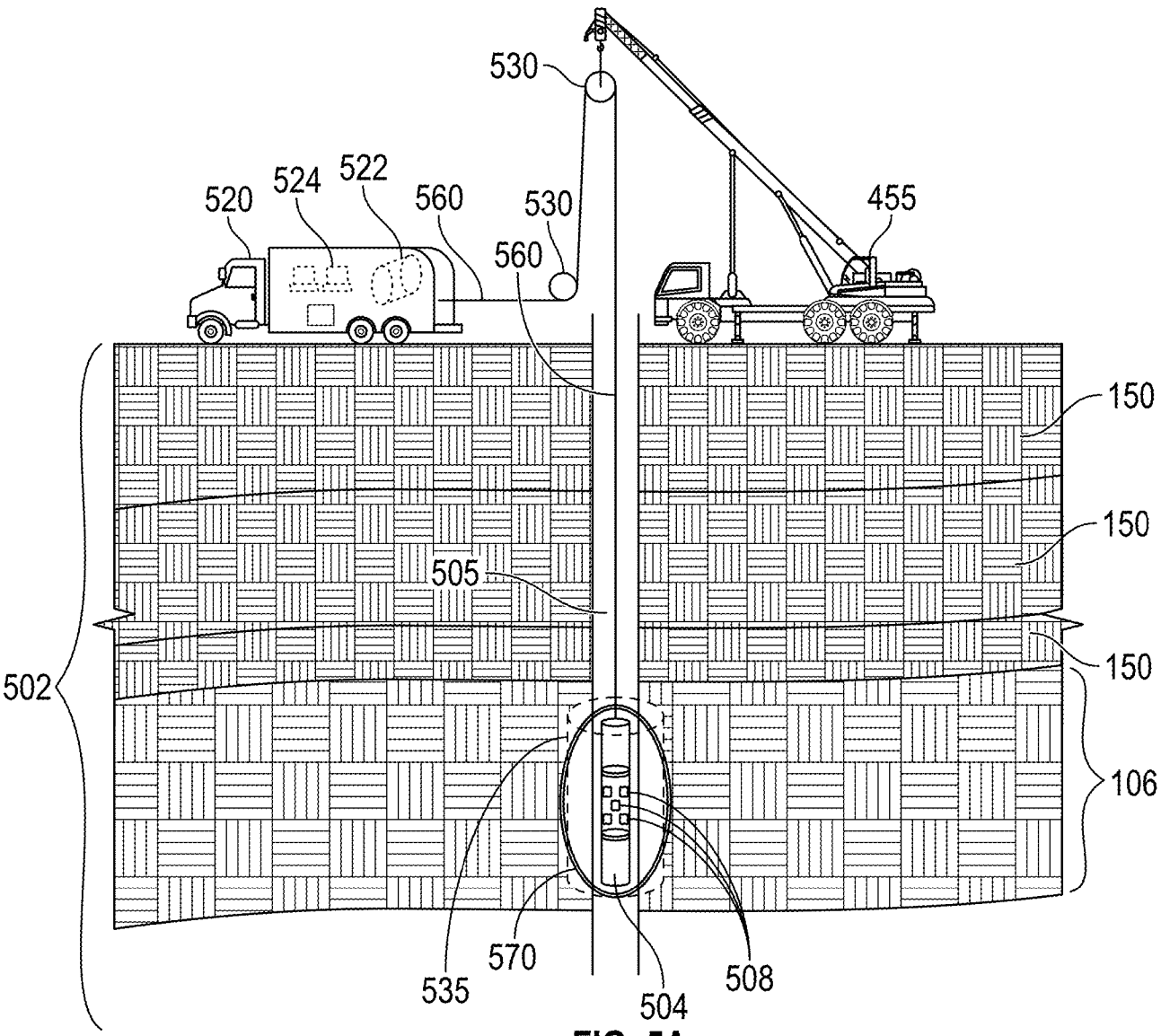
FIG. 5A depicts an ultrasonic stimulation system in accordance with one or more embodiments.

In accordance with one or more embodiments, FIG. 5A depicts an ultrasonic stimulation tool (504) including one or more ultrasonic transducers (508) disposed on a cylindrical housing (506) deployed on a wireline (560) in a wellbore (505) penetrating a subterranean region of interest (502). The subterranean region of interest (502) may include a variety of rock layers (150) and one or more hydrocarbon reservoirs (106). The wireline (560) runs from a wireline truck (520) around one or more sheeve wheels (530), such as a sheeve wheel attached to the head of the wellbore (505). In some embodiments, a sheeve wheel may be suspended from a crane (455) above the head of the wellbore while, in other embodiments, a sheeve wheel (530) may be suspended from the derrick (115) of a drilling system (114) depicted in FIG. 1. Typically, the wireline truck (520) may contain a winch (522), around which the wireline (560) is spooled, and a well logging system (524) configured to transmit digital instructions to, and receive data from, the ultrasonic stimulation tool (504).

In accordance with one or more embodiments, a command transmitted from the logging system via the wireline (560) to the ultrasonic stimulation tool (504). Upon receipt of the command the ultrasonic stimulation tool (504) may activate the ultrasonic stimulation transducers (508) to emit ultrasonic waves (570) at the preferred frequency (466) into the wellbore (505) and insonify the rock formation surrounding the position of the ultrasonic stimulation tool (504). In some embodiments the ultrasonic stimulation tool (504) may be continuously raised or lower over a range of depths within the wellbore (505), by means of spooling or unspooling the wireline (560), while insonifying the rock formation with ultrasonic waves (570). In other embodiments, the ultrasonic stimulation tool (504) may be activated, deactivated, moved to a new location within the wellbore (505), and reactivated in an iterative series of steps. The ultrasonic radiated waves (570) may stimulate a stimulated zone or annulus (535) surrounding the wellbore at a sufficient amplitude to dislodge the fines (206) from the pores (204) and pore throats (206*b*).

Figure 5B:
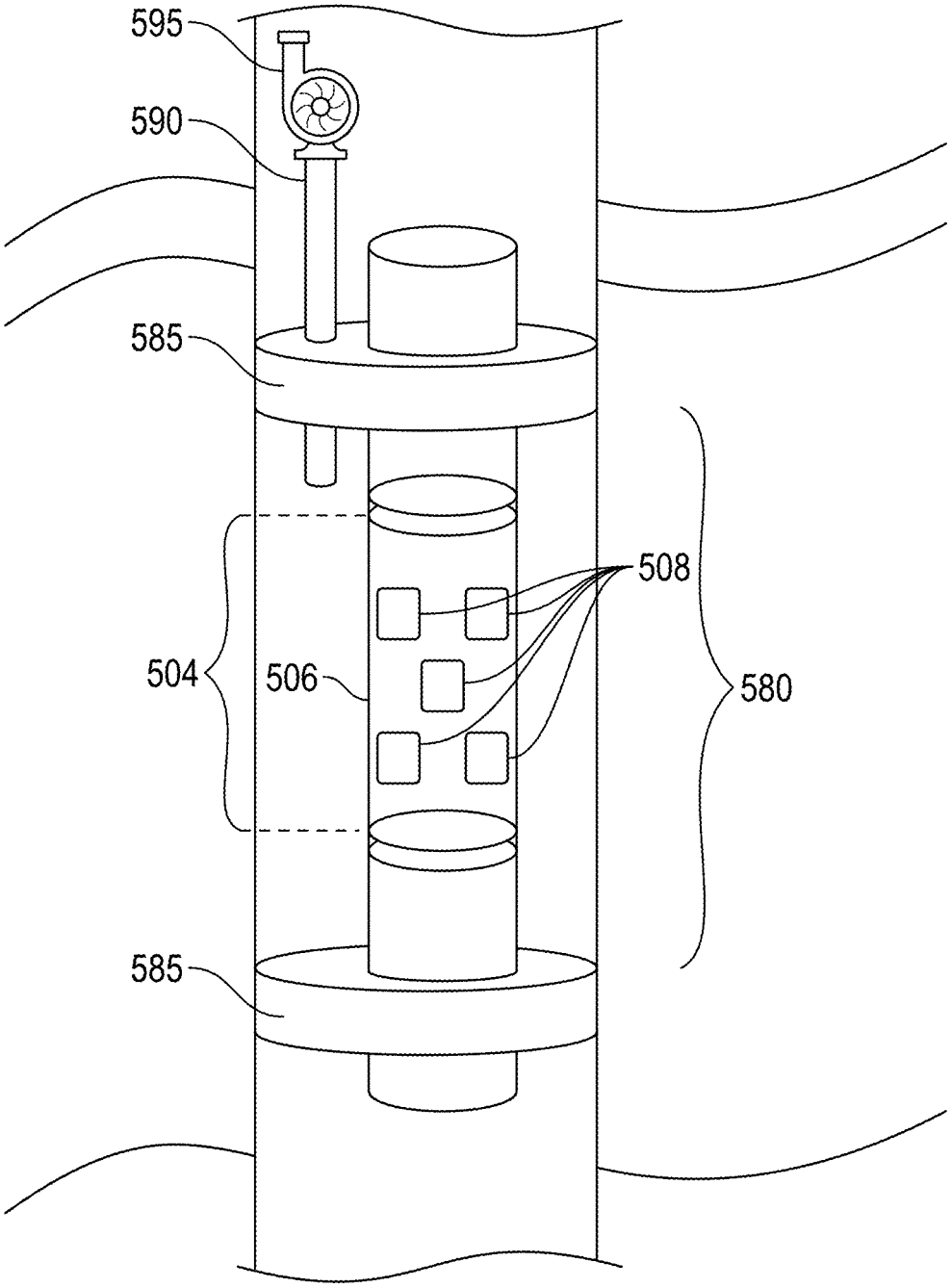
FIG. 5B depicts an ultrasonic stimulation tool in accordance with one or more embodiments.

In other embodiments the ultrasonic stimulation tool (504) may be supplemented by a lowering of hydraulic pressure within a portion of the wellbore. In some embodiments, as shown in FIG. 5B, a portion of the wellbore may be hydraulically isolated from the remainder of the wellbore (505) using hydraulic packers (585). The fluid pressure in the hydraulically isolated portion (580) may be reduced by pumping fluid out from the hydraulically isolated portion (580) through a fluid channel (590). The pumping may be performed using downhole or surface pumps and valves (595). In other embodiments the fluid pressure at the location of the ultrasonic stimulation tool (504) may be lowered without the assistance of packers. The pressure differential produced by the lowered fluid pressure within the wellbore may have the effect of drawing, sucking, or flushing pore fluid and dislodged fines from the stimulated zone (535) into the wellbore (505), thus flushing the stimulated zone (535) and enhancing its permeability.

Figure 6:
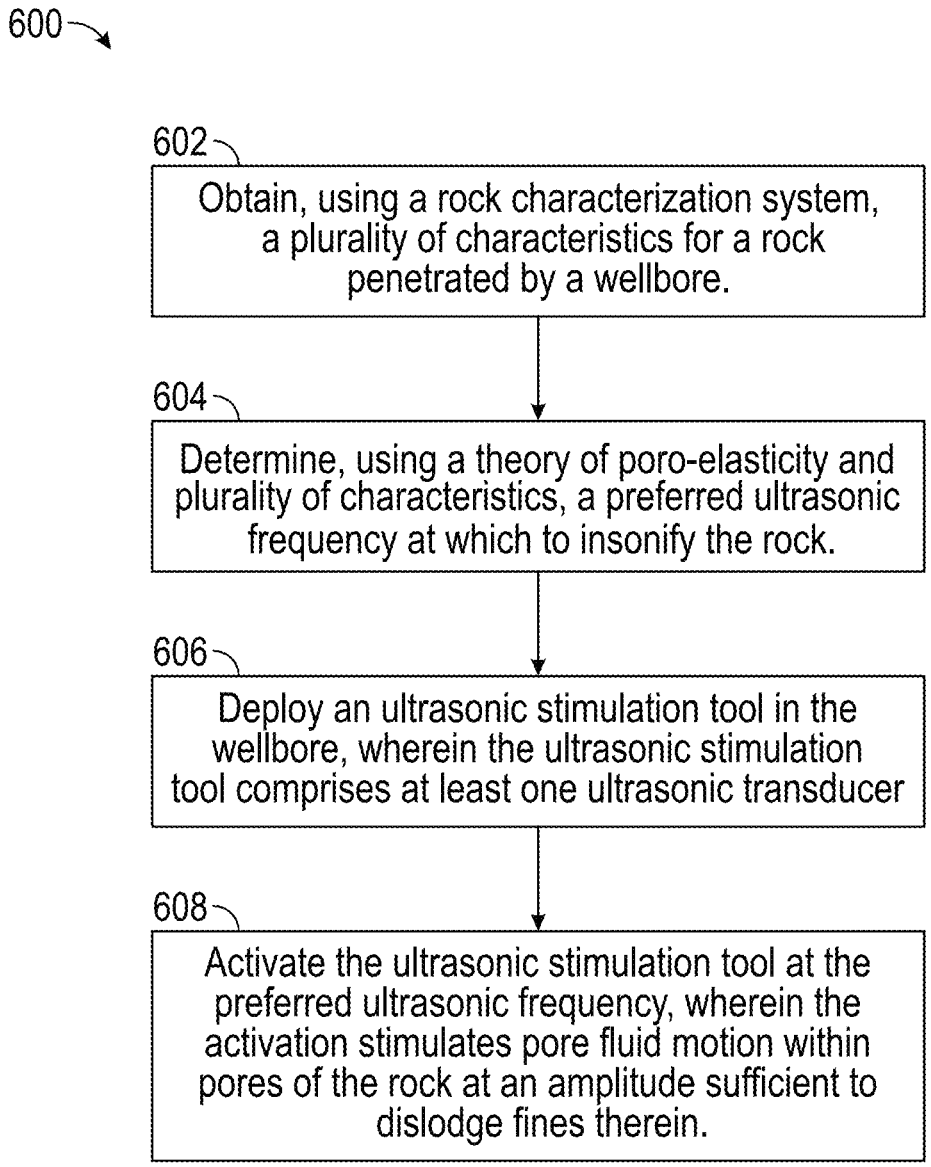
FIG. 6 shows a flowchart of a workflow in accordance with one or more embodiments.

FIG. 6 depicts a flow chart (600) in accordance with one or more embodiments. In Step 602 a plurality of characteristics for a rock penetrated by a wellbore may be obtained using a rock characterization system. The rock characteristics may include Lamé parameters, Biot's coefficient, Biot's modulus, pore fluid density, rock porosity, and fluid mobility. In some embodiments the rock characterization system may include a coring system and in other embodiments the rock characterization system may include one or more well logging tools. In some embodiments the rock characterization system may include laboratory equipment configured to determine the characteristics or rock core In Step (604) a preferred ultrasonic frequency at which to insonify the rock may be determined, using a model of poroelasticity and the plurality of rock characteristics. In some embodiments the preferred ultrasonic frequency may be based on a maximum peak pore pressure at a distance beyond a wall of the wellbore. In some embodiments, the preferred ultrasonic frequency may include a range of preferred frequencies. The preferred ultrasonic frequency may be based, at least in part, on a spatial integral of the peak pore pressure over an annulus beyond the wall of the wellbore. In some embodiments, the model of poroelasticity may be a Biot model of poroelasticity.

In Step (606) an ultrasonic stimulation tool may be deployed in the wellbore. The ultrasonic stimulation tool may include at least one ultrasonic transducer. In some embodiments, a plurality of hydraulic packers may be deployed, where the hydraulic packers are configured to isolate a portion of the wellbore containing the ultrasonic stimulation tool within the portion.

In Step (608) the ultrasonic stimulation tool may be activated at the preferred ultrasonic frequency. The activation may stimulate pore fluid motion within pores of the rock at an amplitude sufficient to dislodge fines therein. The ultrasonic stimulation tool may include lowering the ultrasonic stimulation tool into the wellbore using a wireline. Activating the ultrasonic stimulation tool may further include using a pumping system, to generate a pressure differential between the wellbore fluid pressure and the pore fluid pressure of the rock, where the pressure differential is sufficient to flush pore fluid and dislodge fines from the rock into the wellbore and pump the dislodged fines to a distant location such as the surface of the earth.

Figure 7:
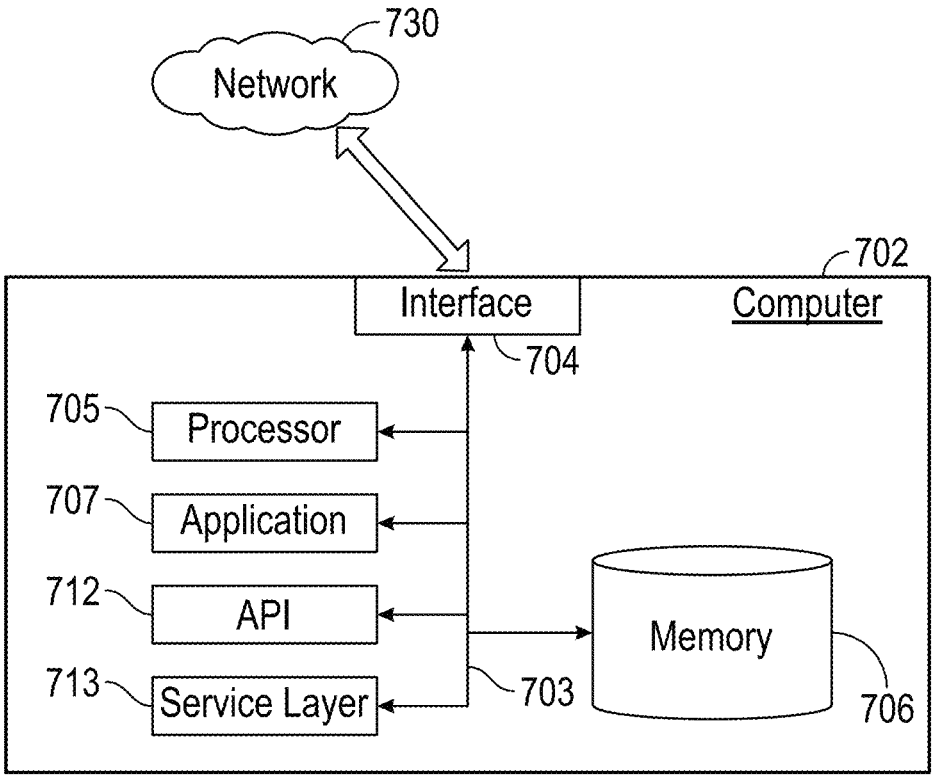
FIG. 7 shows a computer system in accordance with one or more embodiments.

In some embodiments, a computer system may be used to determine the preferred frequency and in some embodiments the well logging system may include a computer system. FIG. 7 is a block diagram of a computer system (700) used to provide computational functionalities associated with described algorithms, methods, functions, processes, flows, and procedures as described in the instant disclosure, according to an implementation. The illustrated computer system (700) is intended to encompass any computing device such as a high performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer system (700) may include a computer that includes an input device, such as a keypad, keyboard, touch screen, or other device that can accept user information, and an output device that conveys information associated with the operation of the computer system (700), including digital data, visual, or audio information (or a combination of information), or a GUI.

The computer system (700) can serve in a role as a client, network component, a server, a database or other persistency, or any other component (or a combination of roles) of a computer system for performing the subject matter described in the instant disclosure. The illustrated computer system (700) is communicably coupled with a network (702). In some implementations, one or more components of the computer system (700) may be configured to operate within environments, including cloud-computing-based, local, global, or other environment (or a combination of environments).

At a high level, the computer system (700) is an electronic computing device operable to receive, transmit, process, store, or manage data and information associated with the described subject matter. According to some implementations, the computer system (700) may also include or be communicably coupled with an application server, e-mail server, web server, caching server, streaming data server, business intelligence (BI) server, or other server (or a combination of servers).

The computer system (700) can receive requests over network (702) from a client application (for example, executing on another computer system (700)) and responding to the received requests by processing the said requests in an appropriate software application. In addition, requests may also be sent to the computer system (700) from internal users (for example, from a command console or by other appropriate access method), external or third-parties, other automated applications, as well as any other appropriate entities, individuals, systems, or computers.

Each of the components of the computer system (700) can communicate using a system bus (704). In some implementations, any or all of the components of the computer system (700), both hardware or software (or a combination of hardware and software), may interface with each other or the interface (706) (or a combination of both) over the system bus (704) using an application programming interface (API) (708) or a service layer (710) (or a combination of the API (708) and service layer (710). The API (708) may include specifications for routines, data structures, and object classes. The API (708) may be either computer-language independent or dependent and refer to a complete interface, a single function, or even a set of APIs. The service layer (710) provides software services to the computer system (700) or other components (whether or not illustrated) that are communicably coupled to the computer (700). The functionality of the computer (700) may be accessible for all service consumers using this service layer. Software services, such as those provided by the service layer (710), provide reusable, defined business functionalities through a defined interface. For example, the interface may be software written in JAVA, C++, or other suitable language providing data in extensible markup language (XML) format or other suitable format. While illustrated as an integrated component of the computer (700), alternative implementations may illustrate the API (708) or the service layer (710) as stand-alone components in relation to other components of the computer (700) or other components (whether or not illustrated) that are communicably coupled to the computer (700). Moreover, any or all parts of the API (708) or the service layer (710) may be implemented as child or sub-modules of another software module, enterprise application, or hardware module without departing from the scope of this disclosure.

The computer (700) includes an interface (706). Although illustrated as a single interface (706) in FIG. 7, two or more interfaces (706) may be used according to particular needs, desires, or particular implementations of the computer (700). The interface (706) is used by the computer (700) for communicating with other systems in a distributed environment that are connected to the network (702). Generally, the interface (706) includes logic encoded in software or hardware (or a combination of software and hardware) and operable to communicate with the network (702). More specifically, the interface (706) may include software supporting one or more communication protocols associated with communications such that the network (702) or interface's hardware is operable to communicate physical signals within and outside of the illustrated computer (700).

The computer (700) includes at least one computer processor (712). Although illustrated as a single computer processor (712) in FIG. 7, two or more processors may be used according to particular needs, desires, or particular implementations of the computer (700). Generally, the computer processor (712) executes instructions and manipulates data to perform the operations of the computer (700) and any algorithms, methods, functions, processes, flows, and procedures as described in the instant disclosure.

The computer (700) also includes a memory (714) that holds data for the computer (700) or other components (or a combination of both) that may be connected to the network (702). For example, memory (714) may be a database storing data consistent with this disclosure. Although illustrated as a single memory (714) in FIG. 7, two or more memories may be used according to particular needs, desires, or particular implementations of the computer (700) and the described functionality. While memory (714) is illustrated as an integral component of the computer (700), in alternative implementations, memory (714) may be external to the computer (700).

In addition to holding data, the memory may be a non-transitory medium storing computer readable instruction capable of execution by the computer processor (712) and having the functionality for carrying out manipulation of the data including mathematical computations.

The application (716) is an algorithmic software engine providing functionality according to particular needs, desires, or particular implementations of the computer (700), particularly with respect to functionality described in this disclosure. For example, application (716) can serve as one or more components, modules, applications, etc. Further, although illustrated as a single application (716), the application (716) may be implemented as multiple applications (716) on the computer (700). In addition, although illustrated as integral to the computer (700), in alternative implementations, the application (716) may be external to the computer (700).

There may be any number of computers (700) associated with, or external to, a computer system containing computer (700), each computer (700) communicating over network (702). Further, the term "client," "user," and other appropriate terminology may be used interchangeably as appropriate without departing from the scope of this disclosure. Moreover, this disclosure contemplates that many users may use one computer (700), or that one user may use multiple computers (700).

In some embodiments, the computer (700) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, cloud computing system may operate according to one or more service models, such as infrastructure as a service (IaaS), platform as a service (PaaS), software as a service (SaaS), mobile "backend" as a service (MBaaS), serverless computing, artificial intelligence (AI) as a service (AIaaS), and/or function as a service (FaaS).

Although only a few example embodiments have been described in detail above, those skilled in the art will readily appreciate that many modifications are possible, including dimensions, in the example embodiments without materially departing from this invention. Accordingly, all such modifications are intended to be included within the scope of this disclosure as defined in the following claims.

What is claimed:

1. A method, comprising:

obtaining, using a rock characterization system, a plurality of characteristics for a rock penetrated by a wellbore;

determining, using a model of poroelasticity and the plurality of characteristics, a preferred ultrasonic frequency at which to insonify the rock;

deploying an ultrasonic stimulation tool in the wellbore, wherein the ultrasonic stimulation tool comprises at least one ultrasonic transducer; and activating the ultrasonic stimulation tool at the preferred ultrasonic frequency, wherein the preferred ultrasonic frequency is based, at least in part, on maximizing a peak pore pressure at a distance beyond a wall of the wellbore.

2. The method of claim 1, further comprising:

generating, using a pumping system, a pressure differential between a wellbore fluid pressure and a pore fluid pressure of the rock, wherein the pressure differential is sufficient to flush pore fluid and dislodge fines from the rock into the wellbore; and pumping the dislodged fines to a distant location.

3. The method of claim 2, further comprising deploying a plurality of hydraulic packers configured to isolate a portion of the wellbore, wherein the ultrasonic stimulation tool is located within the portion.

4. The method of claim 1, wherein the model of poroelasticity comprises Biot's model of poroelasticity.

5. The method of claim 4, wherein Biot's model determines the preferred frequency from rock characteristics comprising Lamé parameters, Biot's coefficient, Biot's modulus, pore fluid density, rock porosity, and a fluid mobility.

6. The method of claim 1, wherein the rock characterization system comprises a coring system.

7. The method of claim 1, wherein the preferred ultrasonic frequency further comprises a range of preferred frequencies.

8. The method of claim 1, wherein the preferred ultrasonic frequency is based, at least in part, on a spatial integral of the peak pore pressure over an annulus beyond the wall of the wellbore.

9. The method of claim 1, wherein deploying the ultrasonic stimulation tool comprises lowering the ultrasonic stimulation tool into the wellbore using a wireline.

10. An ultrasonic stimulation tool comprising:

a cylindrical housing having a first end and a second end;

a first hydraulic packer mounted on the cylindrical housing proximal the first end and a second hydraulic packer mounted on the cylindrical housing proximal the second end;

a fluid channel penetrating the first hydraulic packer;

a pumping system fluidly connected to the fluid channel; and an ultrasonic transducer mounted on the cylindrical housing and disposed between the hydraulic packer proximal to each end, configured to emit radiated ultrasonic waves at a preferred frequency upon command from a well logging system, wherein the preferred frequency is determined, using a model of poroelasticity, from characteristics of a rock, and wherein the preferred ultrasonic frequency is based, at least in part, on maximizing a peak pore pressure at a distance beyond a wall of the wellbore.

11. An ultrasonic stimulation system, comprising:

a rock characterization system configured to obtain a plurality of characteristics for a rock penetrated by a wellbore;

a computer system configured to determine, using a model of poroelasticity and the plurality of characteristics, a preferred ultrasonic frequency at which to insonify the rock;

an ultrasonic stimulation tool comprising at least one ultrasonic transducer, configured to emit radiated ultrasonic waves at the preferred frequency upon receipt of a command from a well logging system;

wherein the preferred ultrasonic frequency is based, at least in part, on maximizing a peak pore pressure at a distance beyond a wall of the wellbore; and a well logging system configured to transmit a command to activate the ultrasonic stimulation tool.

12. The system of claim 11, further comprising:

a pumping system configured to generate a pressure differential between a wellbore fluid pressure and a pore fluid pressure of the rock, wherein the pressure differential is sufficient to flush pore fluid and dislodge fines from the rock into the wellbore.

13. The system of claim 12, further comprising a plurality of hydraulic packers.

14. The system of claim 11, wherein the model of poroelasticity comprises Biot's model of poroelasticity.

15. The system of claim 11, wherein the rock characteristics comprise Lamé parameters, Biot's coefficient, Biot's modulus, pore fluid density, rock porosity, and a fluid mobility.

16. The system of claim 11, wherein the rock characterization system comprises a coring system.

17. The system of claim 11, wherein the preferred ultrasonic frequency further comprises a range of preferred frequencies.

18. The system of claim 11, wherein the preferred ultrasonic frequency is based, at least in part, on a spatial integral of the peak pore pressure over an annulus beyond the wall of the wellbore.

* * * * *